US008882522B2

(12) United States Patent
Jiang

(10) Patent No.: US 8,882,522 B2
(45) Date of Patent: Nov. 11, 2014

(54) ELECTRICAL CONNECTOR

(71) Applicant: Concraft Holding Co., Ltd., Grand Cayman (KY)

(72) Inventor: Yong-Hong Jiang, Grand Cayman (KY)

(73) Assignee: Concraft Holdings Co., Ltd., Grand Cayman (KY)

( * ) Notice: Subject to any disclaimer, the term of this patent is extended or adjusted under 35 U.S.C. 154(b) by 63 days.

(21) Appl. No.: 13/859,202

(22) Filed: Apr. 9, 2013

(65) Prior Publication Data

US 2014/0302720 A1 Oct. 9, 2014

(51) Int. Cl.
*H01R 13/62* (2006.01)
*H01R 12/72* (2011.01)

(52) U.S. Cl.
CPC ..... *H01R 12/722* (2013.01)
USPC ..... 439/160

(58) Field of Classification Search
CPC ..... H01R 13/633; H01R 13/62938
USPC ..... 439/160, 157, 153, 328, 327, 326
See application file for complete search history.

(56) References Cited

U.S. PATENT DOCUMENTS

| | | | | |
|---|---|---|---|---|
| 7,371,103 | B2 * | 5/2008 | McGrath et al. | 439/352 |
| 7,927,114 | B2 * | 4/2011 | Li et al. | 439/108 |
| 8,251,727 | B2 * | 8/2012 | Zhu | 439/327 |
| 8,357,003 | B1 * | 1/2013 | Wang | 439/327 |
| 8,465,314 | B2 * | 6/2013 | Kato | 439/327 |
| 2007/0275587 | A1 * | 11/2007 | Chang et al. | 439/327 |

* cited by examiner

*Primary Examiner* — Phuongchi T Nguyen
(74) *Attorney, Agent, or Firm* — Rabin & Berdo, P.C.

(57) ABSTRACT

An electrical connector includes an insulating main body, a terminal module, and two fixing pieces. The insulating main body has a front end provided with an insertion port, two sides of the insertion port each being provided with a fixing slot, and has a rear end provided with an accommodation space. The terminal module is disposed in the accommodation space, and includes metal terminals and a fixing seat. The metal terminals are partially protrudingly exposed in the insertion port. Two sides of the fixing seat are each provided with a clamping slot. Each fixing piece is fixed in the fixing slot. Each fixing piece has a buckle corresponding to the clamping slot. Therefore, the extending buckle of the fixing piece and the clamping slot of the terminal module are engaged with each other, so as to prevent the terminal module from departing from the accommodation space.

8 Claims, 3 Drawing Sheets

ELECTRICAL CONNECTOR

BACKGROUND OF THE INVENTION

1. Technical Field

The present invention relates to an electrical connector, and more particularly to an electrical connector having a thickness-reducing effect.

2. Related Art

An electrical connector is mainly used for linking two different devices. The electrical connector is an indispensable part/component especially on an electronic product. As electronic products become increasingly lighter and thinner, the electrical connector is required to evolve over time.

In a conventional electrical connector, a metal terminal is typically assembled in an insulating main body in a pin-insertion manner, where a wide bard is generally disposed on the metal terminal, and the bard interferes with the insulating main body, so that the metal terminal can be effectively fixed in the insulating main body.

However, the manner requires a large space must be reserved in the insulating main body, so as to fix the metal terminal, which makes the volume of the electrical connector too large, preventing the electronic products being made lighter and thinner.

Therefore, an electrical connector with metal terminals fixed through injection molding is also available on the market. In the electrical connector, various rows of metal terminals are fixed respectively through injection molding, and then assembled in an insulating main body respectively.

However, in the manner a plastic seat must be formed on each row of the metal terminals through injection molding, and then the plastic seats are assembled on the insulating main body respectively, so that each plastic seat must be provided with a buckling device for buckling with the insulating main body, and therefore the plastic seats can be buckled in the insulating main body respectively. In this way, buckling devices must be designed on both the plastic seat and the insulating main body. The space in the insulating main body is limited, and if two buckling devices are required to be further reserved in the insulating main body, the volume of the electrical connector cannot be decreased, and limitation is incurred to the height, preventing the electrical connector being made lighter and thinner.

Therefore, how to provide an electrical connector having the thickness-reducing effect is a technical problem to be solved by the present invention.

SUMMARY

In view of the problems, the present invention provides a terminal module, and more particularly provides an electrical connector having a thickness-reducing effect.

In order to achieve the objective, an electrical connector of the present invention is applied to a circuit board and used for electrically connecting a docking object. The electrical connector includes an insulating main body, a terminal module, and two fixing pieces.

The insulating main body has a front end provided with an insertion port into which the docking object is capable of being inserted, and two sides of the insertion port are each provided with a fixing slot.

The at least one terminal module is disposed in the insulating main body and includes a plurality of metal terminals and a fixing seat. The metal terminals are partially protrudingly exposed at the insertion port of the insulating main body and are connected electrically to the docking object. The fixing seat is used for fixing the metal terminals, and two sides of the fixing seat are each provided with a clamping slot.

Each fixing piece is fixed in the fixing slot of the insulating main body respectively. Each fixing piece has a buckle extending towards an accommodation space of the insulating main body, and the buckle is engaged with the clamping slot of the terminal module.

Therefore, the two fixing pieces lock the terminal module, so as to prevent the terminal module from departing from the insulating main body, thereby meeting thickness-reducing requirements of the electrical connector.

Upper terminal slots and lower terminal slots are further disposed in the insertion port of the insulating main body. The metal terminals further include a plurality of first metal terminals and a plurality of second metal terminals. The first metal terminals partially extend into the upper terminal slots, and the second metal terminals partially extend into the lower terminal slots.

The fixing seat of the terminal module further includes a first fixing seat and a second fixing seat. The first fixing seat is used for fixing the first metal terminals. The second fixing seat is used for fixing the second metal terminals. The two clamping slots are disposed on two sides of the second fixing seat. The first fixing seat and the second fixing seat are fixed on the first metal terminals and the second metal terminals respectively through injection molding.

The first fixing seat is further provided with a positioning hole. A positioning portion is protrudingly disposed on a position, opposite to the positioning hole of the first fixing seat, on the second fixing seat, and the positioning portion and the positioning hole are embedded in each other, thereby preventing the first fixing seat from departing.

The first metal terminals are partially exposed in the positioning hole of the first fixing seat, and a plurality of grooves is additionally disposed on the positioning portion of the second fixing seat, so that the metal terminals exposed in the positioning hole can be partially embedded in the grooves.

An accommodation space is further formed at a rear end of the insulating main body, two sides of the accommodation space are each provided with a guide slot, and each guide slot is in communication with a fixing slot respectively.

Two sides of the fixing seat of the terminal module are each provided with a guide block. The guide blocks correspond to the guide slots of the insulating main body, and the two clamping slots are disposed on the two guide blocks respectively.

Each fixing piece is further provided with a soldering portion, and one side of each fixing piece is further provided with a barb.

BRIEF DESCRIPTION OF THE DRAWINGS

The present invention will become more fully understood from the detailed description given herein below for illustration only, and thus not limitative of the present invention, wherein.

DETAILED DESCRIPTION

To make the objectives, technical solutions, and advantages of the present invention clearer, the present invention is described below in detail with reference to the accompanying drawings and specific embodiments.

Figure 1:
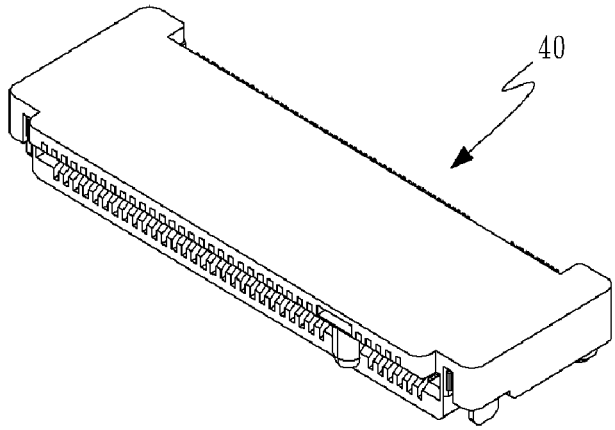
FIG. 1 is a schematic three-dimensional view according to the present invention.
Figure 2:
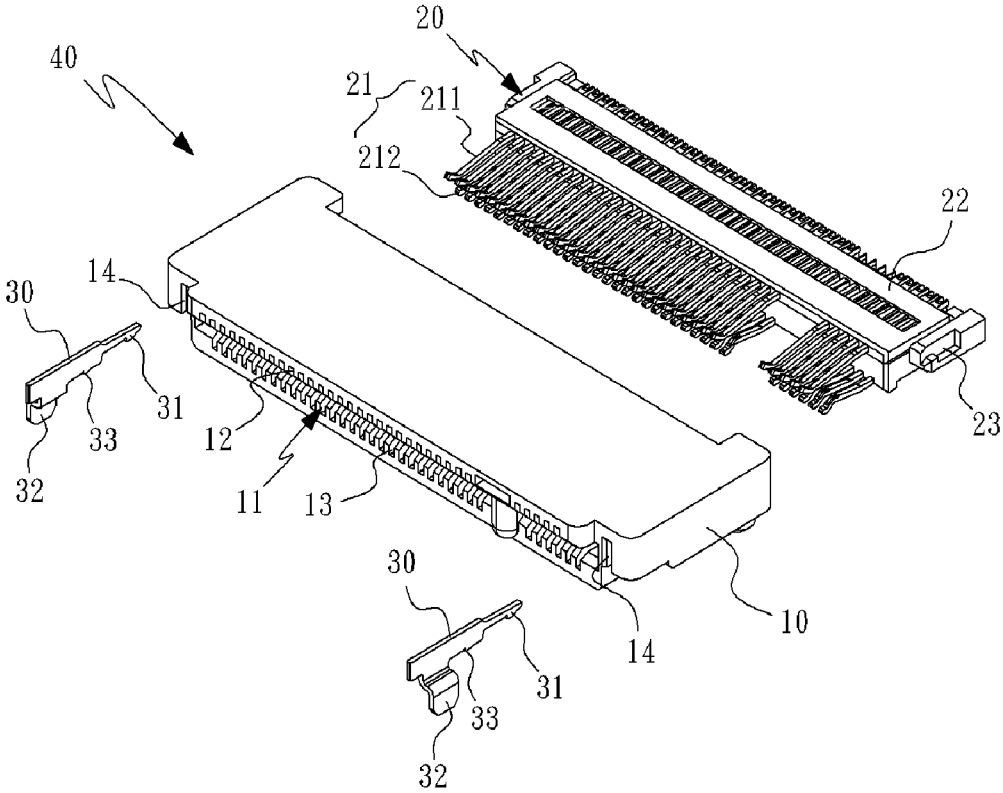
FIG. 2 is a schematic three-dimensional exploded view according to the present invention.

As shown in FIG. 1 and FIG. 2, FIG. 1 is a schematic three-dimensional view according to the present invention, and FIG. 2 is a schematic three-dimensional exploded view according to the present invention. As shown in the drawings, an electrical connector of the present invention is mainly applied to a circuit board (not shown), and is connected electrically to a docking object (for example expansion modules for expansion on a circuit board, such as a DDR, a PCI, a PCI Express, a Mini PCI, and an NGFF). The electrical connector 40 of the present invention includes an insulating main body 10, a terminal module 20, and two fixing pieces 30.

A front end of the insulating main body 10 is provided with an insertion port 11 into which a docking object may be inserted. Upper and lower sides in the insertion port 11 are provided with a plurality of upper terminal slots 12 and a plurality of lower terminal slots 13 respectively. Left and right sides of the insertion port 11 are each provided with a fixing slot 14.

The terminal module 20 is disposed in the insulating main body 10, and includes a plurality of metal terminals 21 and a fixing seat 22. The metal terminals 21 are partially exposed in the insertion port 11 of the insulating main body 10, and are used for being connected electrically to the docking object. The fixing seat 22 is used for fixing the metal terminals 21, and left and right sides of the fixing seat 22 are each provided with a clamping slot 23.

In this embodiment, the metal terminals 21 include a plurality of first metal terminals 211 and a plurality of second metal terminals 212. The first metal terminals 211 are fixed at an upper portion of the fixing seat 22, partially extend into the upper terminal slots 12 of the insulating main body 10, and are partially exposed at an upper portion of the insertion port 11 of the insulating main body 10. The second metal terminals 212 are fixed at a lower portion of the fixing seat 22, partially extend into the lower terminal slots 13 of the insulating main body 10, and are partially exposed at a lower portion of the insertion port 11 of the insulating main body 10.

Each fixing piece 30 is disposed in the fixing slot 14 of the insulating main body 10. Each fixing piece 30 has a buckle 31 extending along a direction of the terminal module 20. The buckle 31 is in the insulating main body 10 and is engaged with the clamping slot 23 of the terminal module 20. Each fixing piece 30 is further provided with a soldering portion 32 and at least one barb 33. The soldering portion 32 is used for being soldered on the circuit board. The barb 33 is disposed on one side of the fixing piece 30, and is used for fixing the fixing piece 30 in the fixing slot 14 of the insulating main body 10.

Figure 3:
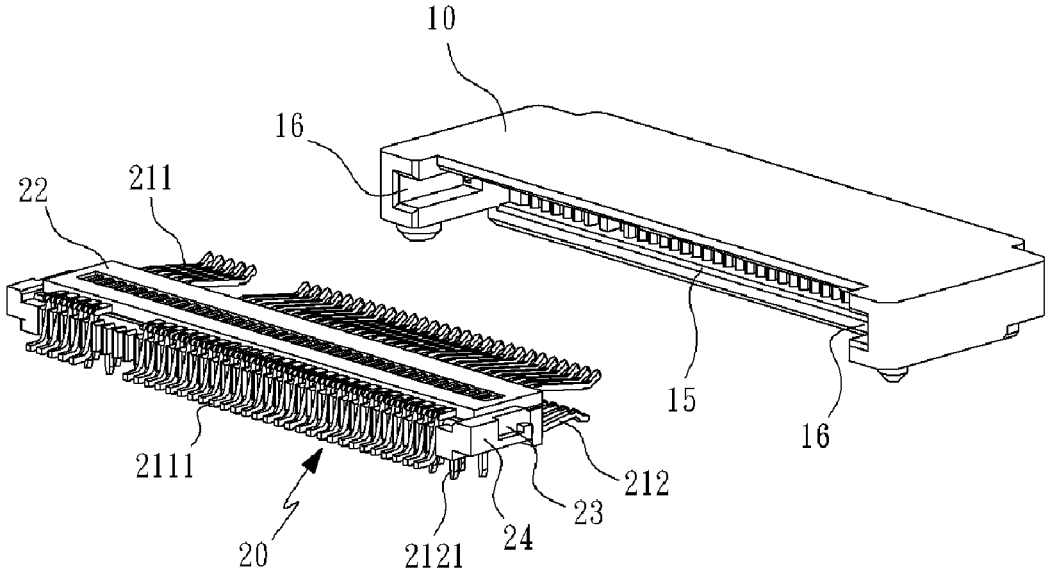
FIG. 3 is a schematic three-dimensional exploded view in another viewing angle according to the present invention.

Please refer to FIG. 3, which is a schematic three-dimensional exploded view in another viewing angle according to the present invention. As shown in the drawing, an accommodation space 15 is further formed at a rear end of the insulating main body 10 of the present invention. The accommodation space 15 is in communication with the insertion port 11, and the terminal module 20 is disposed in the accommodation space 15, so that the first metal terminals 211 and the second metal terminals 212 can run through the upper terminal slots 12 and the lower terminal slots 13, so as to be partially protrudingly exposed in the insertion port 11.

Further, left and right sides of the accommodation space 15 of the insulating main body 10 are each provided with a guide slot 16. The guide slots 16 are in communication with the fixing slots 14 respectively. Positions, opposite to the guide slots 16, on left and right sides of the fixing seat 22 are each additionally provided a guide block 24. The clamping slots 23 are disposed on the guide blocks 24.

Further, the first metal terminals 211 further have a row of first soldering portions 2111 extending behind the fixing seat 22, and the second metal terminals 212 further have two rows of second soldering portions 2121 extending below the fixing seat 22. The first soldering portions 2111 and the second soldering portions 2121 are used for being connected electrically to the circuit board, so that the docking object is connected electrically to the circuit board.

Figure 4:
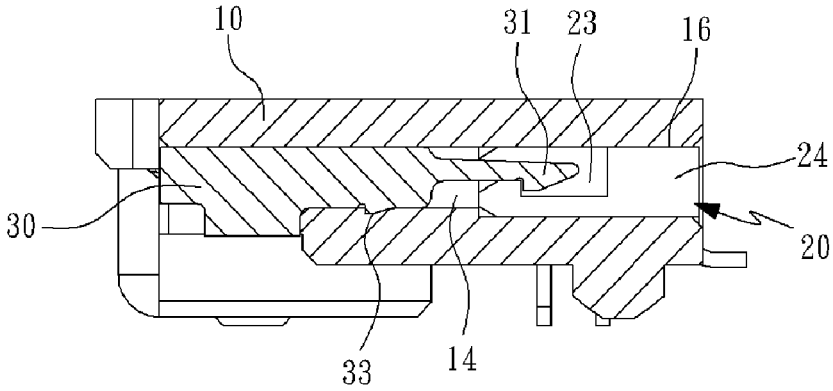
FIG. 4 is a schematic sectional view according to the present invention.

Please refer to FIG. 4, which is a schematic sectional view according to the present invention. As shown in the drawing, in order to assemble the electrical connector of the present invention, after the guide blocks 24 of the terminal module 20 are made to correspond to the guide slots 16 of the insulating main body 10, the terminal module 20 is mounted in the insulating main body 10, so that the terminal module 20 is received in the accommodation space 15 of the insulating main body 10.

Then, after each fixing piece 30 is made to correspond to the fixing slot, the fixing pieces 30 are mounted in the fixing slots 14 one by one. The barb 33 of each fixing piece 30 achieves an engaging effect with a slot wall in the fixing slot 14, so as to prevent the fixing piece 30 from departing.

Further, when the fixing piece 30 is mounted in the fixing slot 14, since the fixing piece 30 has a buckle 31 extending at a front end thereof, the buckle 31 extends into the guide slot 16 and is engaged with the clamping slot 23 on the guide block 24, and the fixing piece 30 and the terminal module 20 pull each other in an insertion direction, thereby preventing the terminal module 20 and the fixing pieces 30 from departing in the insertion direction of the insulating main body 10.

It should be noted that, in the present invention, for the terminal module 20, the buckle 31 at the front end of each fixing piece 30 is engaged with the clamping slot 23 of the fixing seat 22, so that no buckle mechanism is required to be additionally disposed on the insulating main body 10, and an effective engaging effect can still be achieved by the insulating main body 10 in the limited space, so as to effectively decrease the height of the insulating main body 10, thereby enabling the electrical connector to meet thickness-reducing requirements.

Figure 5:
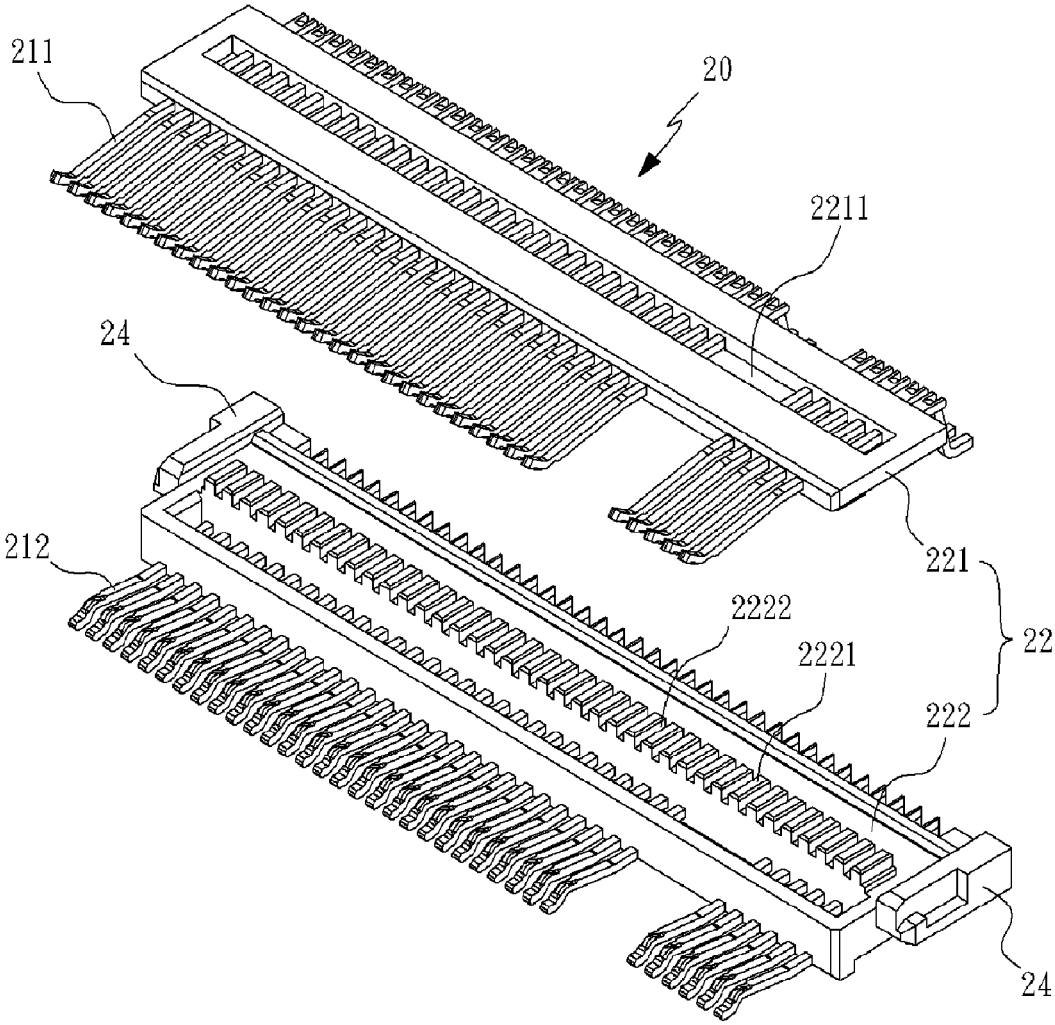
FIG. 5 is a schematic exploded view of a second embodiment of a terminal module according to the present invention.

Further, in order to better meet the thickness-reducing requirements of the electrical connector, Please refer to FIG. 5, which is a schematic exploded view of a second embodiment of the terminal module according to the present invention, and in addition to that the terminal module 20 of the present invention includes the first metal terminals 211 and the second metal terminals 212, the fixing seat 22 further includes a first fixing seat 221 and a second fixing seat 222. The first fixing seat 221 fixes the first metal terminals 211 through injection molding. The second fixing seat 222 fixes the second metal terminals 212 through injection molding. The guide blocks 24 are disposed on left and right sides of the second fixing seat 222.

The first fixing seat 221 is further provided with a positioning hole 2211 along an arrangement direction of the first metal terminals 211. The positioning hole 2211 runs through the first fixing seat 221, so that the first metal terminals 211 are partially exposed in the positioning hole 2211.

The second fixing seat 222 is further provided with a positioning portion 2221 protruding towards the first fixing seat 221. The positioning portion 2221 extends along an arrangement direction of the second metal terminals 212, and corresponds to the positioning hole 2211 of the first fixing seat 221. A plurality of grooves 2222 is additionally disposed on the positioning portion 2221. Each groove 2222 corresponds to a first metal terminal 211 exposed in the positioning hole 2211.

Therefore, when the first fixing seat 221 and the second fixing seat 222 are combined, the positioning portion 2221 of the second fixing seat 222 is embedded in the positioning hole 2211 of the first fixing seat 221, so that each first metal terminal 211 exposed in the positioning hole 2211 is embedded in a corresponding groove 2222, so as to make the first fixing seat 221 and the second fixing seat 222 embedded in each other.

It should be noted that, the first fixing seat 221 and the second fixing seat 222 are formed on the first metal terminals 211 and the second metal terminals 212 respectively through injection molding, thereby enabling the first fixing seat 221 and the second fixing seat 222 to meet thickness-reducing requirements. The first fixing seat 221 and the second fixing seat 222 have the overlapping thickness, that is, achieve a thickness overlapping effect through the positioning portion 2221 and the positioning hole 2211, so as to effectively reduce the thickness of the first fixing seat 221 and that of the second fixing seat 222, thereby reducing the thickness of the whole terminal module 20. Relatively, the volume of the insulating main body 10 is reduced, thereby making the whole electrical connector better meet the thickness-reducing requirements.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical connector, applied to a circuit board and used for electrically connecting a docking object, the electrical connector comprising:

an insulating main body, having a front end provided with an insertion port into which the docking object is capable of being inserted, wherein two sides of the insertion port are each provided with a fixing slot;

at least one terminal module, disposed in the insulating main body and comprising a plurality of metal terminals and a fixing seat, wherein the metal terminals are partially protrudingly exposed at the insertion port of the insulating main body and are connected electrically to the docking object, the fixing seat is used for fixing the metal terminals, and two sides of the fixing seat are each provided with a clamping slot; and two fixing pieces, fixed in the fixing slots of the insulating main body respectively, wherein each fixing piece has a buckle extending towards an accommodation space of the insulating main body, and the buckle is engaged with the clamping slot of the terminal module;

wherein upper terminal slots and lower terminal slots are further disposed in the insertion port of the insulating main body, the metal terminals further comprise first metal terminals and second metal terminals, the first metal terminals partially extend into the upper terminal slots, and the second metal terminals partially extend into the lower terminal slots;

wherein the fixing seat of the terminal module comprises a first fixing seat and a second fixing seat, the first fixing seat is used for fixing the first metal terminals, the second fixing seat is used for fixing the second metal terminals, and the two clamping slots are disposed on two sides of the second fixing seat.

2. The electrical connector according to claim 1, wherein the first fixing seat and the second fixing seat are fixed on the first metal terminals and the second metal terminals respectively through injection molding.

3. The electrical connector according to claim 1, wherein the first fixing seat is further provided with a positioning hole, a positioning portion is protrudingly disposed on a position, opposite to the positioning hole of the first fixing seat, on the second fixing seat, and the positioning portion and the positioning hole are embedded in each other.

4. The electrical connector according to claim 3, wherein the first metal terminals are partially exposed in the positioning hole, a plurality of grooves is additionally disposed on the positioning portion of the second fixing seat, and the metal terminals exposed in the positioning hole are partially embedded in the grooves.

5. The electrical connector according to claim 1, wherein an accommodation space is further formed at a rear end of the insulating main body, two sides of the accommodation space are each provided with a guide slot, and each guide slot is in communication with a fixing slot respectively.

6. The electrical connector according to claim 5, wherein two sides of the fixing seat of the terminal module are each provided with a guide block, the guide blocks correspond to the guide slots of the insulating main body, and the two clamping slots are disposed on the two guide blocks respectively.

7. The electrical connector according to claim 1, wherein each fixing piece is further provided with a soldering portion.

8. The electrical connector according to claim 7, wherein one side of each fixing piece is further provided with a barb.

* * * * *